US010407218B2

(12) United States Patent
Hartmut

(10) Patent No.: US 10,407,218 B2
(45) Date of Patent: Sep. 10, 2019

(54) LOCKABLE DRAWSTRING BAG

(71) Applicant: LEMO Maschinenbau GmbH, Niederkassel-Mondorf (DE)

(72) Inventor: Odenthal Hartmut, Troisdorf (DE)

(73) Assignee: LEMO MASCHINENBAU GMBH, Niederkassel-Mondorf (DE)

( * ) Notice: Subject to any disclaimer, the term of this patent is extended or adjusted under 35 U.S.C. 154(b) by 3 days.

(21) Appl. No.: 15/572,912

(22) PCT Filed: Jun. 17, 2016

(86) PCT No.: PCT/EP2016/064019
§ 371 (c)(1),
(2) Date: Nov. 9, 2017

(87) PCT Pub. No.: WO2016/202988
PCT Pub. Date: Dec. 22, 2016

(65) Prior Publication Data
US 2018/0282025 A1 Oct. 4, 2018

(51) Int. Cl.
*B65D 33/28* (2006.01)
*B65F 1/00* (2006.01)

(52) U.S. Cl.
CPC ..... *B65D 33/28* (2013.01); *B65F 1/002* (2013.01)

(58) Field of Classification Search
CPC ..... B65D 33/28
USPC ..... 428/4, 24; 383/71–77; 24/712–712.4, 24/713, 713.2, 714.3–714.5, 715–715.2, 24/713.7, 713.8, 715.7
See application file for complete search history.

(56) References Cited

U.S. PATENT DOCUMENTS

| | | | | |
|---|---|---|---|---|
| 4,813,794 | A | 3/1989 | Herrington | |
| 8,790,009 | B2 | 7/2014 | Saville | |
| 2011/0243482 | A1* | 10/2011 | First | B65D 33/004 383/72 |
| 2014/0241847 | A1* | 8/2014 | Short | B65D 33/01 414/800 |
| 2017/0158380 | A1* | 6/2017 | Ross | B65D 33/24 |
| 2018/0050843 | A1* | 2/2018 | Kaensche | B65D 33/28 |

FOREIGN PATENT DOCUMENTS

DE 9307723 A 9/1993

* cited by examiner

*Primary Examiner* — Jes F Pascua
*Assistant Examiner* — Nina K Attel
(74) *Attorney, Agent, or Firm* — Andrew Wilford

(57) ABSTRACT

The invention relates to a drawstring bag (1) made of two lateral parts (2, 3) which are connected together at the lateral edges (4) of the parts. A receiving region for a drawstring (7) is provided in the opening-side region of the drawstring bag (1), and a drawstring (7) is arranged in the receiving region. The drawstring (7) is connected to the drawstring bag (1) on one side and is freely accessible on the other side. The invention is characterized in that a locking strip (11) arranged on the drawstring (7) is provided between the region connected to the drawstring bag (1) and the freely accessible region of the drawstring (7), said locking strip coming into contact with an opening edge of the receiving region for the drawstring (7) when the locking strip has left the receiving region.

10 Claims, 2 Drawing Sheets

LOCKABLE DRAWSTRING BAG

CROSS REFERENCE TO RELATED APPLICATIONS

This application is the US-national stage of PCT application PCT/EP2016/064019 filed 17 Jun. 2016 and claiming the priority of German patent application 102015109768.0 itself filed 18 Jun. 2015.

FIELD OF THE INVENTION

The invention relates to a drawstring bag made of two face panels that are interconnected at side edges, a casing for a drawstring being provided at a mouth of the drawstring bag and a drawstring provided in this casing, the drawstring being connected to the drawstring bag at one end and freely accessible on the other end

BACKGROUND OF THE INVENTION

Such drawstring bags used for example as trash bags are known. They are manufactured in an appropriate manner such that three sides of the drawstring bag are closed, thus forming a container for receiving any manner of objects. The fourth side is open in order enable objects to be placed into the bag. After filling, the bag can be closed in an inherently known manner by pulling on the drawstring that is confined in its casing. As a result of this pulling on the drawstring, the drawstring is pulled out of the casing and the fourth side of the drawstring bag, which has heretofore been open, is drawn together, thereby closing the bag.

This type of closure for drawstring bags by a drawstring has inherently proven its worth. However, depending on the type of object to be introduced into the bag, and also depending on the handling of the bag, it is possible for the part of the drawstring that has been pulled out of this casing to slip back into this casing. This automatically has the effect that the previously closed drawstring bag opens at least partially, or even completely in the worst case, and the objects that were previously placed into the bag can intentionally or unintentionally come out of the bag. Particularly in a case in which trash has been filled into the bag, for example, it is disadvantageous if the bag can open up again.

OBJECT OF THE INVENTION

It is therefore the object of the invention to improve a known drawstring bag to the effect that, once the bag is closed, it remains closed. If at all, it should only be possible to open the bag again under the application of a substantial amount of force or against a resistance.

SUMMARY OF THE INVENTION

According to the invention, a locking strip is provided between the end that is connected to the bag and the freely accessible end of the drawstring that comes to rest against an opening edge of the casing for the drawstring when it has left this casing. When the bag has been filled and is to be closed, one pulls on the drawstring in the usual manner so that it largely leaves the casing in which it has been located up to now. The side edge of the opening of the bag is drawn together along the drawstring, so that this opening is closed as a result. At the same time, the locking strip is also moved out of the casing as a result until it is no longer in the casing and is visible from the outside. This means that the locking strip comes to rest against an opening edge of the casing for the drawstring when it has left this casing, and the drawstring is advantageously and effectively prevented from sliding back into the casing. At the same time, this has the consequence that the already-closed opening of the bag remains closed, because, by virtue of the locking strip, it is not possible for the drawstring to slip back into its casing. The locking strip now locks quasi only a small portion of the drawstring within the casing, while the majority of the drawstring is located outside of the casing. Only if a substantially greater force is applied (in order to overcome the locking strip during the return into the casing) or if the locking strip is manually guided back into the casing, for example, is it possible to open the bag, and this opening process is then carried out deliberately and no longer inadvertently as in the prior art.

The locking strip can be formed in various ways.

In one embodiment of the invention, the locking strip is glued to the drawstring. Alternatively or in addition, the locking strip is welded to the drawstring. Both possibilities offer the advantage that various ways exist for fastening the locking strip to the drawstring. For instance, the locking strip can be attached to the drawstring before it is threaded into the casing. On the other hand, it is conceivable for the locking strip to be fastened to the drawstring when the drawstring has already been threaded into the casing.

In a development of the invention, the locking strip is a piece that is separate from the face panel and the drawstring, particularly a patch of plastic film, a paper strip, or the like. This offers the advantage of geometric freedom with respect to the size, extension, thickness, and material of the film.

In a development of the invention, the locking strip is not formed as a part that is separate from the bag or drawstring; instead, it is formed from a face panel of the bag, the so-called parent material, preferably by a die-cutting process. This offers the advantage of especially simple manufacturing, since the bag can first be produced with the casing for the drawstring, after which the drawstring can be introduced into the casing. The locking strip is then die-cut, perforated, or the like from the face panel, with the doe-cut part being permanently connected to the drawstring subsequently, simultaneously, or beforehand. Once again, this can be achieved by gluing, welding, or the like.

Just like web or comparable connections, a connection between the locking strip and the face panel of the bag offers the advantage that the drawstring is first set in a defined position in the casing. Only after the bag has been filled is it possible to pull on the freely accessible part of the drawstring, at which point the locking strip is detached from the face panel under the application of a minimal force. Alternatively, the locking strip can also be completely separated from the face panel, even if it is formed by it.

For example, there are two possibilities for the making the casing for the drawstring.

For one, in a development of the invention, the casing for the drawstring is formed as a channel extending along an upper edge of the face panel. This means that the casing for the drawstring is channel-shaped in the upper edge region of the face panel, with only the upper edge of the face panel being used to form the casing. The handling of additional parts for the formation of the bag can thus be avoided, rendering the manufacture of such a drawstring bag especially advantageous, because, in this case as well, the locking strip is optionally formed in an especially advantageous manner from the face panel.

As an alternative, in one development of the invention the casing for the drawstring is formed by an overlay strip that is connected along its edges to the face panel. Another configuration for the casing is thus made available in which a web strip is used that is placed on the surface of the face panel and connected by its side edges to the face panel. The casing for the drawstring is thus produced. Here, too, it is conceivable either for the locking strip to be detached from the face panel or the locking strip, or it is also conceivable for the locking strip to again be formed by a portion of the face panel or of the overlay strip.

In an especially advantageous embodiment, the bag has a sinusoidal upper bag edge (so-called sine bags), with a hand hole optionally provided in the sinusoidal bag edge. The hand hole can be used to hang or carry the bag.

Drawstring bags are formed as trash bags, simple flat bags, bread bags, freezer bags, or the like. Preferably, both the bag itself and the drawstring are made of the same material, particularly plastic, thus advantageously improving recycling. Various plastics are also conceivable. Likewise, it is conceivable for the material of the bag and the material of the drawstring to be the same or different colors, which also entails advantages with respect to recycling. For instance, the fact that the bag and drawstring are different colors can indicate that they are made of different materials. Conversely, the same color means the same material.

Whether made of the same or a different material than the bag, the drawstring can be thicker (enabling it to withstand greater tension, for example by virtue of having a greater thickness than the face panel of the bag) and/or elastic. With such an elastic drawstring, it is possible—when used in a drawstring bag designed as a trash bag in a rigid trash container, for example—to place the upper edge of the trash bag around the upper edge of the trash container and to tighten the elastic drawstring around this upper container edge.

While it was assumed above that the drawstring is an elongate plastic film, it can also have a different design. For instance, the drawstring can be a cord, string, or the like (made of plastic, natural material, or a combination thereof). In this embodiment, as well as the embodiment made of plastic, the locking strip placed thereon need not have the shape of a strip. If the drawstring is formed as an elongate strip, the locking strip is preferably square, rectangular, round, or oval-shaped. If the drawstring is formed as a cord, string, or the like, the locking strip is formed as a knot or connected to the string as a clip, thickening, or the like. Regardless of how it is configured, it is important that the shape enable this locking strip, knot, clip, or the like to catch on an opening edge of the casing for the strip-like drawstring, the cord, the string, or the like after it has left this casing.

BRIEF DESCRIPTION OF THE DRAWING

In the following, the invention will be explained in further detail with reference to two embodiments, to which it is not however limited.

SPECIFIC DESCRIPTION OF THE INVENTION

Figure 1:
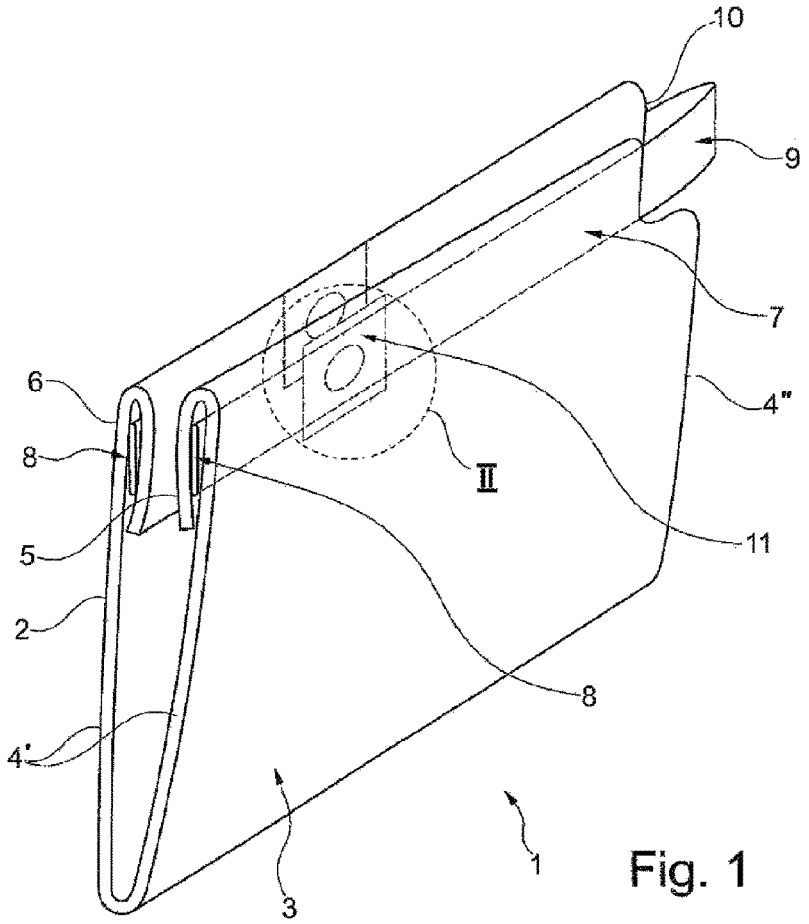
FIG. 1 shows a drawstring bag with a lockable drawstring.

To the extent that it is shown in detail, a drawstring bag is shown in FIG. 1 that consists of two opposing face panels 2, 3. The face panels 2 and 3 have side edges 4' and 4" that interconnect the two face panels 2 and 3. In the lower part when looking at FIG. 1, the face panels 2 and 3 are folded over in approximately a U-shape, so that this fold and the connection of the two face panels 2 and 3 by their side edges 4' and 4" results in a drawstring bag 1 that is initially closed on three sides. At the upper end when looking at FIG. 1, the bag 1 is initially open. Channels 5 and 6 are formed by the upper edges of the face panels 2 and 3 at the upper end of the bag 1. As a result of the folding-over of the upper edges of the face panels 2 and 3 to form the channels 5 and 6, a casing is created on both sides for a drawstring 7. The drawstring 7 has a fixed drawstring end 8 at one of the side edges 4'. It extends thence along each of the channels 5 and 6 and projects out at the side edge 4" opposite from the fixed drawstring end 8 and forms there an accessible, free drawstring end 9. At the free drawstring end 9, a cutout 10 can but need not be provided in the upper edge region of the bag 1. If this cutout 10 is present, the free drawstring end 9 (particularly where it loops from the channel 5 toward the channel 6) advantageously ends there in alignment with the side edge 4". It is also conceivable, however, to have the free drawstring end 9 project beyond the side edge 4". Moreover, an additional aid can be provided in this region of the free drawstring end 9 for gripping (tag).

A locking strip 11 is provided on the drawstring 7 that is optionally provided within the channel 5 and thus not visible and/or not accessible. This is the case particularly if the locking strip 11 was fastened to the drawstring before the drawstring 7 was threaded into the channel 5. Alternatively, the locking strip 11 is accessible and/or visible from the outside either if a hole has been provided in the channel 5 or if the locking strip 11 is formed from the face panel 2 by die cutting, perforation, or the like. If the drawstring 7 is in the channel 5, for example, the locking strip 11 can be die-cut after the face panel 2 has been glued, welded, or the like to the drawstring 7 before the die cutting.

Figure 2:
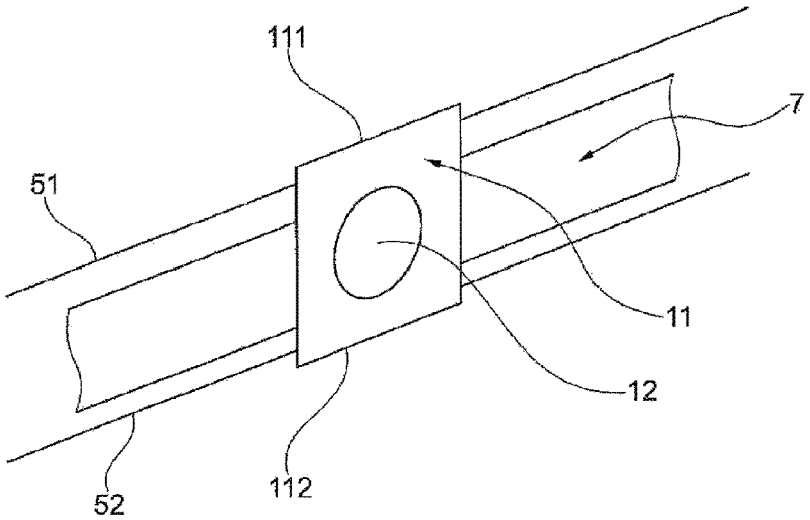
FIG. 2 shows detail II of FIG. 1.

This configuration of detail II is very clearly visible in FIG. 2. There, it is shown that the drawstring 7 has been provided with the locking strip 11 by the permanent and non-detachable interconnection of these two parts by a bond 12. As mentioned previously, this can be made a gluing process, a welding process, or a combination thereof or the like. The channel 5 has upper and lower edges 51 and 52 (FIG. 2). The locking strip 11 itself has an upper edge 111 and a lower edge 112. If the two edges 111 and 112 lie outside of the opening of the channel 5, which is defined by the edges 51 and 52, it is necessary to pull on the drawstring 7 with somewhat greater force at its free drawstring end 9 in order to pull the larger-sized locking strip 11 into the casing, that is, into the channel 5. If the edges 51 and 111 on the one hand and 52 and 112 on the other hand are aligned, this indicates that the locking strip 11 can but need not be formed from the face panel 2. In this case as well, it is conceivable for the edges 51/111 and 52/112 to be aligned and for the locking strip 11 to be a component that is separate from the face panel 2.

Figure 3:
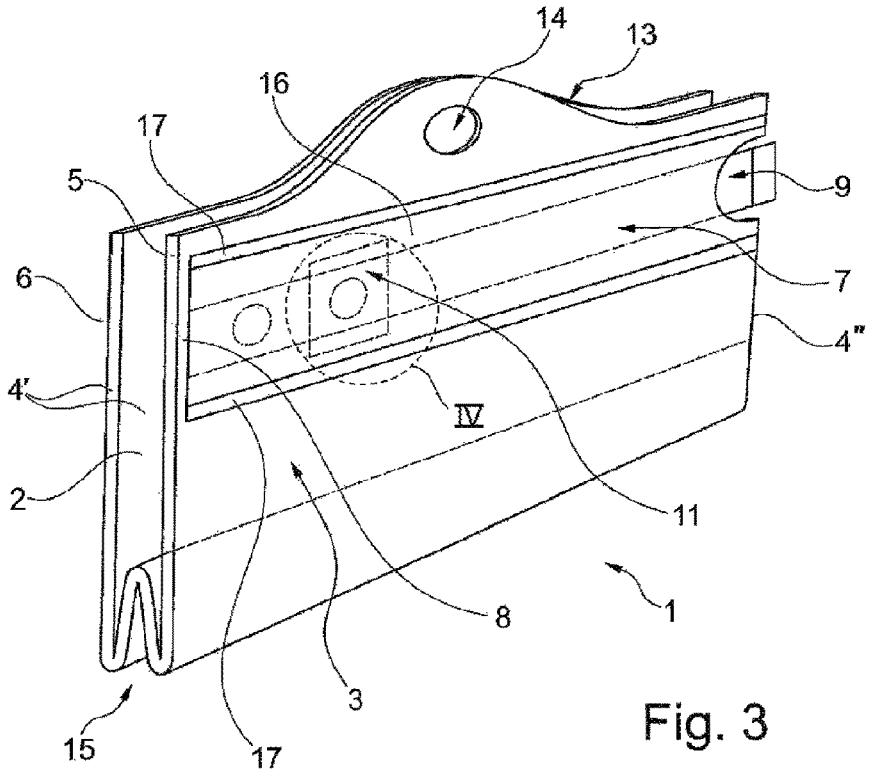
FIG. 3 shows a sine bag with a lockable drawstring.

As an alternative to the bag 1 illustrated in FIG. 1, FIG. 3 shows a sine bag with the same principle of the locking strip 11.

The sine bag according to FIG. 3 differs from the bag according to FIG. 1 in that it has a sinusoidal upper bag edge 13 in which a hand hole 14 is optionally formed, particularly die cut.

A lower gusseted bag bottom 15 is present on the side opposite the opening side at the sinusoidal upper bag edge 13 that offers the advantage that, as the two face panels 2 move apart, the initially folded-over bag bottom 15 offers a greater surface for placing objects after the sine bag is filled.

In the embodiment according to FIG. 3 (alternatively to the bag according to the embodiment in FIG. 1), the channel 5 and 6 is formed by an additional overlay strip 16 that is placed with its side edges (fastening seam 17) on the surface of the face panel 2 and non-detachably connected thereto. The fastening seam 17 can be continuous, segmental, or punctiform and achieved by gluing, welding, or the like. Here, too, just as in FIG. 1, the drawstring 7 is securely attached with its fixed drawstring end 8 at the side edge 4', and the free drawstring end 9 is freely accessible at the opposite side edge 4" away from the fixed drawstring end 8.

Figure 4:
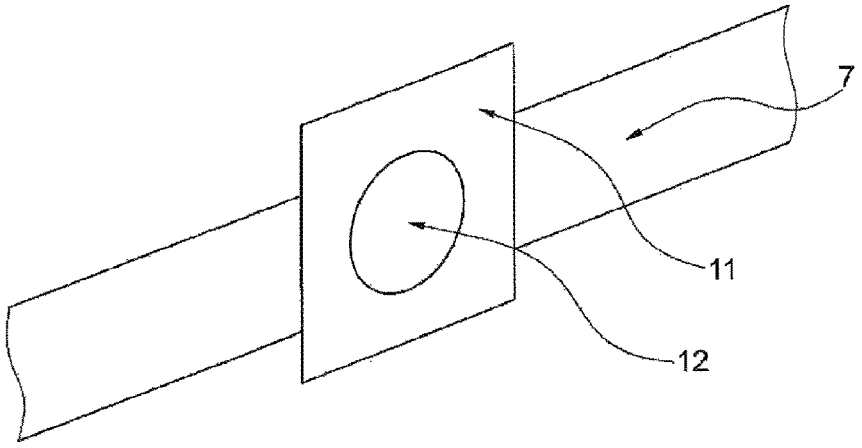
FIG. 4 shows detail IV of FIG. 3.

FIG. 4 shows the detail IV according to FIG. 3.

It holds for both embodiments that, after the bag is filled, the drawstring 7 can be gripped at its free drawstring end 9 and pulled out of the casing (formed by the channels 5 and 6). By moving the majority of the drawstring 7 out of its casing, including the locking strip 11, the bag is not only closed, but the locking strip 11 comes to rest against the side edge 4" at the free drawstring end 9. When the locking strip comes to rest there or, optionally, overlaps somewhat outside of the lateral region of the bag at the side edge 4" (while the bond 12 comes to rest against the side edge 4), the bag can no longer be opened or open unintentionally, so that it advantageously remains permanently closed. Nevertheless, if one wishes to open the bag once again, this can be done by gripping the upper end of the bag at the opening and moving apart the two face panels that were drawn together after closing. Sufficient force is required for this in order to move the locking strip 8, which was previously resting against the side edge 4 at the free drawstring end 9, back into the casing. More or less force is needed in order to reopen the bag depending on the design of the locking strip 11.

The drawstring 7 described above, which can be locked by the locking strip 11, can be used in drawstring and sine bags (as shown), as well as in other suitable bags.

In the two embodiments described above, it was shown and described that the drawstring is connected securely to the respective face panel with one end on one side of the bag, whereas a portion of the drawstring is freely accessible on the opposite side of the face panel and is not connected to the respective face panel, so that it can be gripped and pulled out.

Alternatively, consideration can also be given—without restriction to one of the depicted exemplary embodiments—to the possibility of the drawstring being securely connected to the face panel in its respective casing on or in the face panel on both side edges of the respective face panel, and of an opening, cutout, or the like being provided in the respective face panel in the region between these two secure connections, in which a free drawstring end is located that allows the drawstring to be gripped and pulled out of its casing.

Both of the variants described above, as well as analogous modifications, have the effect that the drawstring can be gripped at a freely accessible end (either the drawstring end or an end of an extension of the drawstring) and pulled out of its casing, thereby not only closing the bag when the majority of the drawstring has been pulled out of the casing, but the pulled-out locking strip also comes to rest against an opening edge of the casing for the drawstring once it has left this casing, thus permanently closing the bag (with the option of reopening it).

It is especially advantageous to use plastic material to make the bag, drawstring, and locking strip, although other materials such as paper or combinations of materials are also conceivable.

The invention claimed is:

1. A drawstring bag comprising:

two face panels interconnected at side edges, a casing for a drawstring provided at a mouth of the bag, a drawstring provided in this casing and having one end connected to the bag and a freely accessible other end, and a locking strip formed from the casing and mounted on the drawstring between the end connected to the bag and the freely accessible other end of the drawstring so as to come to rest against an open end of the casing for the drawstring when the drawstring has mostly left this casing.

2. The drawstring bag defined in claim 1, wherein the locking strip is glued onto the drawstring.

3. The drawstring bag defined in claim 1, wherein the locking strip is connected by a weld to the drawstring.

4. The drawstring bag defined in claim 1, wherein the locking strip is detachably connected to at least one of the two face panels.

5. The drawstring bag defined in claim 4, wherein the locking strip is connected by a perforation to at least one of the two face panels.

6. The drawstring bag defined in claim 1, wherein the casing for the drawstring is formed as a channel by a fold of an upper edge of each of the two face panels.

7. The drawstring bag defined in claim 1, wherein the casing for the drawstring is formed by an overlay strip connected along its edges at an upper edge of at least one of the two face panels.

8. The drawstring bag defined claim 1, wherein the drawstring bag has a sinusoidal upper bag edge.

9. A drawstring bag comprising:

two face panels interconnected at side edges, a casing for a drawstring provided at a mouth of the bag, a drawstring provided in this casing and having one end connected to the bag and a freely accessible other end, and a locking strip formed by a die-cut piece of one of the two face panels of the bag and mounted on the drawstring between the end connected to the bag and the freely accessible other end of the drawstring so as to come to rest against an open end of the casing for the drawstring when the drawstring has mostly left this casing.

10. A drawstring bag comprising:

two face panels interconnected at side edges, a casing for a drawstring provided at a mouth of the bag, a drawstring provided in this casing and having one end connected to the bag and a freely accessible other end, and a locking strip mounted on the drawstring between the end connected to the bag and the freely accessible other end of the drawstring so as to come to rest against an open end of the casing for the drawstring when the drawstring has mostly left this casing, one of the two face panels being folded over to form the casing and is formed with a hole through which the locking strip is welded to the drawstring.

* * * * *